US009639058B1

(12) United States Patent
Mohanty et al.

(10) Patent No.: US 9,639,058 B1
(45) Date of Patent: May 2, 2017

(54) TIMEPIECE WITH MOVABLE CASE

(71) Applicant: Fossil Group, Inc., Richardson, TX (US)

(72) Inventors: Manali Mohanty, Plano, TX (US); Jonathan Roman, Dallas, TX (US); Kwan Ka Lee, Hong Kong (CN)

(73) Assignee: Fossil Group, Inc., Richardson, TX (US)

( * ) Notice: Subject to any disclaimer, the term of this patent is extended or adjusted under 35 U.S.C. 154(b) by 0 days.

(21) Appl. No.: 15/073,267

(22) Filed: Mar. 17, 2016

(51) Int. Cl.
*G04B 37/12* (2006.01)
*G04B 37/00* (2006.01)
*A44C 5/14* (2006.01)

(52) U.S. Cl.
CPC ..... *G04B 37/12* (2013.01); *A44C 5/14* (2013.01); *G04B 37/0008* (2013.01)

(58) Field of Classification Search
CPC ..... G04B 37/12; G04B 37/0008; A44C 5/14
USPC ... 368/282, 76, 80, 223, 228, 239, 276–277, 368/281
See application file for complete search history.

(56) References Cited

U.S. PATENT DOCUMENTS 1,798,619 A * 3/1931 Mealy ..... A44C 5/14 24/265 WS
1,930,416 A 10/1933 Chauvot
2,182,194 A * 12/1939 Blau ..... G04B 37/0436 224/163
2,775,861 A * 1/1957 Fachon ..... G04B 37/1486 224/164
4,470,708 A 9/1984 Nee
4,493,561 A 1/1985 Bouchet
D282,913 S 3/1986 Stevens
D294,010 S 2/1988 Bouchet
4,862,435 A * 8/1989 Reichel ..... A44C 15/0025 224/167
D352,469 S 11/1994 Schlup
5,479,381 A 12/1995 Goldenberg
6,176,612 B1 * 1/2001 Chagnoux ..... A44C 5/14 224/168
D447,704 S 9/2001 Deguines
6,522,602 B2 2/2003 Nussbaum
7,507,017 B2 3/2009 Chevalier et al.
8,256,952 B2 9/2012 Loiseau
9,468,268 B2 * 10/2016 Chien ..... A44C 5/0007
2006/0018202 A1 1/2006 Girardin et al.
2009/0257323 A1 10/2009 Soltani
2013/0167585 A1 7/2013 Goeller

FOREIGN PATENT DOCUMENTS

CH 659167 A 1/1987
CH 673556 A 3/1990
CH 680329 A 8/1992
(Continued)

*Primary Examiner* — Edwin A. Leon
(74) *Attorney, Agent, or Firm* — Kirby B. Drake; Klemchuk LLP

(57) ABSTRACT

A timepiece may include a movable case that may rotate approximately 180 degrees with respect to a first link and a second link. The case may include a first pair of tracks and a second pair of tracks that may be provided on opposite sides of the case. A first link and a second link may each slidably engage both the first pair of tracks and the second pair of tracks, so that the case may rotate 360 degrees about the first link and the second link.

15 Claims, 6 Drawing Sheets

(56) References Cited

FOREIGN PATENT DOCUMENTS

| | | | |
|---|---|---|---|
| CH | 698912 | B1 | 12/2009 |
| DE | 3535331 | A1 | 4/1987 |
| EP | 0562522 | A1 | 9/1996 |
| EP | 1840678 | A1 | 10/2010 |
| EP | 2487548 | A1 | 8/2012 |
| FR | 0041060 | E | 11/1931 |
| FR | 2583897 | A1 | 12/1986 |
| FR | 2716353 | A1 | 8/1995 |
| FR | 2742027 | A1 | 6/1997 |
| GB | 2119974 | B | 10/1985 |
| GB | 2219188 | A | 6/1989 |
| GB | 2258134 | A | 3/1993 |
| JP | 8036069 | A | 2/1996 |
| JP | 2007303843 | A | 11/2007 |
| WO | 2004088436 | A2 | 10/2004 |
| WO | 2009030984 | A1 | 3/2009 |
| WO | 2010032084 | A1 | 3/2010 |
| WO | 2012070986 | A2 | 3/2012 |

* cited by examiner

TIMEPIECE WITH MOVABLE CASE

TECHNICAL FIELD

The present disclosure generally relates to timepieces, and more particularly, to timepieces including a movable case.

BACKGROUND

Generally, timepieces do not provide a movable or a rotatable case. Timepieces that provide a case with the ability to move or rotate typically require complex structures and more components than timepieces without movable or rotatable cases. As a result, timepieces including a movable or a rotatable case lack versatility in both forming multiple timepiece structures and in providing various timepiece orientations. Additionally, timepieces that provide a movable or a rotatable case include an arrangement of components that detrimentally wear the timepiece, thus diminishing the life and aesthetic value of the timepiece within a short period of time. Based on the foregoing, there is a need for a timepiece with a movable or a rotatable case as provided herein.

SUMMARY

Embodiments of the present disclosure generally provide a timepiece that may include a movable case. The movable case may include a first interior portion and may provide a second interior portion. The first interior portion may be parallel to the second interior portion. Additionally, the first interior portion may be provided in a first side of the case, and the second interior portion may be provided in a second side of the case. Further, the first interior portion and the second interior portion may be provided equidistant from a center of the case. The timepiece may further include at least one time indicator provided on the case to display a time. A first pair of tracks may be provided in the first interior portion, and a second pair of tracks may be provided in the second interior portion. A first link may be provided in an interlocking position with both the first pair of tracks and the second pair of tracks. Both a first pin of the first link and a second pin of the first link may engage a first portion of an interior perimeter of the case, and the first portion of the interior perimeter may be provided proximate the first link. A second link may be provided in the interlocking position with both the first pair of tracks and the second pair of tracks. Both a first pin of the second link and a second pin of the second link may engage a second portion of the interior perimeter of the case, and the second portion of the interior perimeter may be provided proximate the second link. The first portion of the interior perimeter of the case may be provided parallel to the second portion of the interior perimeter of the case. Further, the first portion of the interior perimeter of the case and the second portion of the interior perimeter of the case may be provided equidistant from the center of the case. The timepiece may comprise a first position in which both the first link and the second link are provided in the interlocking position. The timepiece also may include a second position in which the case is rotated approximately 180 degrees with respect to the first position. Both the first link and the second link may slidably engage both the first pair of tracks and the second pair of tracks. The first interior portion may be provided within a first recessed area of the case, and the second interior portion may be provided within a second recessed area of the case. The timepiece may further comprise a plurality of extension members comprising one of the plurality of extension members interconnected with the first link through a first opening, wherein the case is parallel and proximate the first link and wherein the first link is parallel and proximate the one of the plurality of extension members, and a second one of the plurality of extension members interconnected with the second link through a second opening, wherein the case is parallel and proximate the second link and wherein the second link is parallel and proximate the second one of the plurality of extension members. The case may rotate approximately 360 degrees about both the first link and the second link, and the case may lock with both the first link and the second link with approximately each 180-degree rotation of the case.

Embodiments of the present disclosure may provide a movable case that may include a first link provided in an interlocking position with both a first pair of tracks and a second pair of tracks. The first link may include first pin and a second pin. Both the first pin and the second pin of the first link may engage a first portion of an interior perimeter of the case, and the first portion of the interior perimeter may be provided proximate the first link. A second link may be provided in the interlocking position with both the first pair of tracks and the second pair of tracks. The second link may provide a first pin and a second pin where both the first pin and the second pin of the second link may engage a second portion of the interior perimeter of the case, and the second portion of the interior perimeter may be provided proximate the second link. The first portion of the interior perimeter of the case may be parallel to the second portion of the interior perimeter of the case. Further, the first portion of the interior perimeter of the case and the second portion of the interior perimeter of the case may be equidistant from a center of the case. The movable case may further comprise a first interior portion provided in a first side of the case, the first interior portion including the first pair of tracks, and a second interior portion provided in a second side of the case, the second interior portion including the second pair of tracks, wherein the first interior portion is parallel to the second interior portion, and the first interior portion and the second interior portion are equidistant from the center of the case. The movable case may further comprise a first position in which both the first link and the second link are provided in the interlocking position. The movable case also may comprise a second position in which the case is rotated approximately 180 degrees with respect to the first position. The first link and the second link may each slidably engage both the first pair of tracks and the second pair of tracks. The first side of the case and the second side of the case may be recessed. The movable case may further comprise a plurality of extension members comprising one of the plurality of extension members interconnected with the first link through a first opening, wherein the case is parallel and proximate the first link and wherein the first link is parallel and proximate the one of the plurality of extension members, and a second one of the plurality of extension members interconnected with the second link through a second opening, wherein the case is parallel and proximate the second link and wherein the second link is parallel and proximate the second one of the plurality of extension members. The case may rotate approximately 360 degrees about both the first link and the second link, and the case may lock with both the first link and the second link with approximately each 180-degree rotation of the case.

The foregoing summary is only intended to provide a brief introduction to selected features that are described in greater detail below in the detailed description. Other technical features may be readily apparent to one skilled in the art from the following drawings, descriptions and claims. As such, this summary is not intended to identify, represent, or highlight features believed to be key or essential to the claimed subject matter. Furthermore, this summary is not intended to be used as an aid in determining the scope of the claimed subject matter.

BRIEF DESCRIPTION OF THE DRAWINGS

Various exemplary embodiments are illustrated by way of example, and not by way of limitation, in the figures of the accompanying drawings in which like reference numerals refer to similar elements and in which.

DETAILED DESCRIPTION

Figure 1:
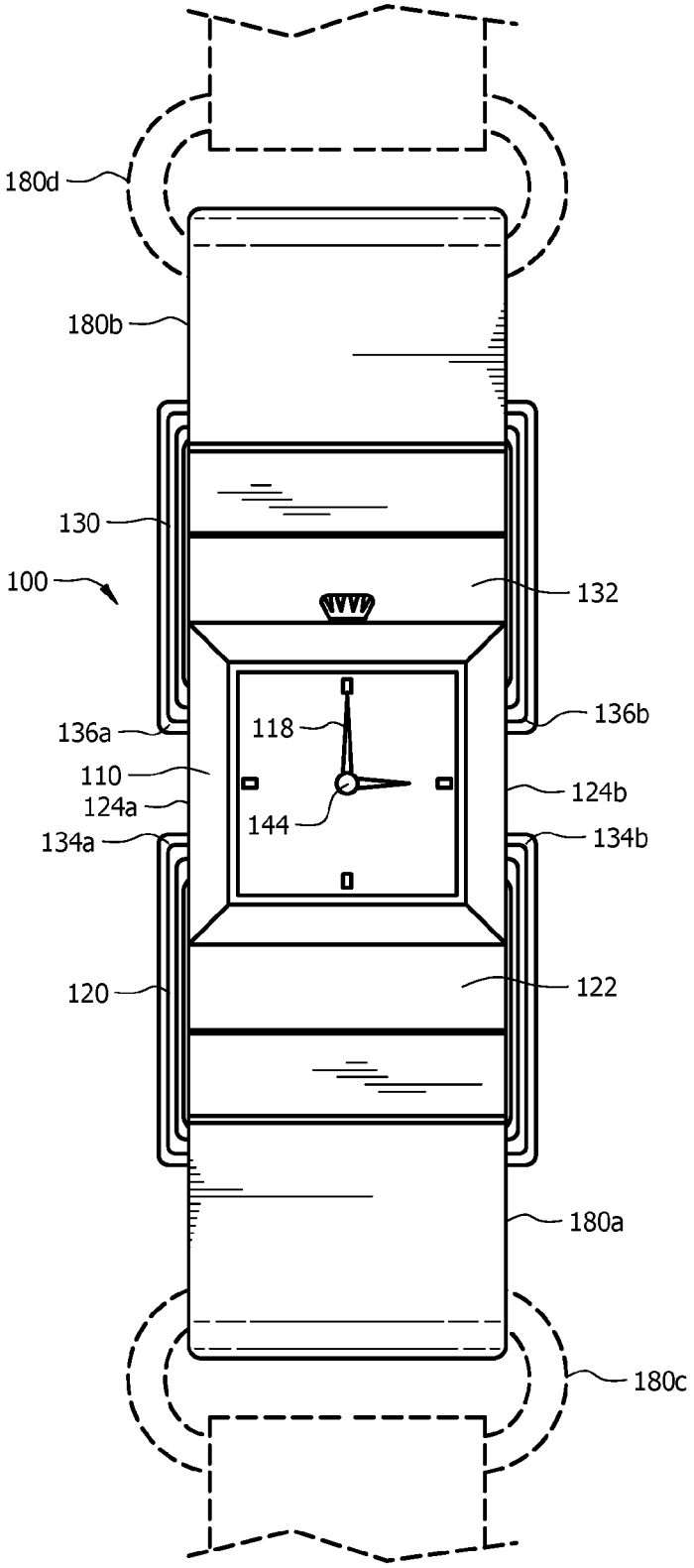
FIG. 1 depicts a top view of a timepiece according to an embodiment of the present disclosure.

The present disclosure generally provides a timepiece that may include a movable case that may rotate approximately 180 degrees with respect to both a first link and a second link. Each link may be attached to opposite sides of the case, so that the first link and the second link may be arranged proximate opposite sides of the case. In the following description, for purposes of explanation, numerous specific details are set forth in order to provide a thorough understanding of the disclosed embodiments. It will become apparent, however, to one skilled in the art that various embodiments may be practiced without these specific details or with an equivalent arrangement.

FIGS. 1-6 depict timepiece 100 according to an embodiment of the present disclosure. Timepiece 100 may include movable case 110 which may provide at least one time indicator 118 to display the time. Timepiece 100 may further include first link 120 and second link 130 provided on opposite sides of case 110. First link 120 may be provided in an interlocking position with case 110, and second link 130 may be provided in an interlocking position with case 110. It should be appreciated that when both first link 120 and second link 130 are provided in interlocking positions with case 110, first link 120 and second link 130 may be provided equidistant from center 144 (FIGS. 1 and 3-6). It should further be appreciated that first link 120 and second link 130 may be provided at any distance from center 144 of case 110 without departing from the present disclosure. First link 120 may provide first opening 122 and second link 130 may provide second opening 132 for rotating and/or moving case 110 about first link 120 and/or about second link 130. Further, first link 120 may include pins 134*a* (FIGS. 1 and 3-6) and 134*b* (FIGS. 1-5) for engaging first portion of interior perimeter 126*a* (FIG. 5) of case 110, and first portion of interior perimeter 126*a* (FIG. 5) may be provided proximate first link 120. Similarly, second link 130 may include pins 136*a* (FIGS. 1 and 3-6) and 136*b* (FIGS. 1-5) for engaging second portion of interior perimeter 126*b* (FIG. 5) of case 110, where second portion of interior perimeter 126*b* may be provided proximate second link 130. It should be appreciated that first portion of interior perimeter 126*a* (FIG. 5) and second portion of interior perimeter 126*b* may be arranged equidistant from center 144 of case 110.

As depicted in FIGS. 1-4 and 6 according to an embodiment of the present disclosure, timepiece 100 may provide extension member 180*a* interconnected with first link 120 through first opening 122. For example, extension member 180*a* may be interconnected with first link 120, such that timepiece 100 provides a parallel arrangement of components in the order of case 110, first link 120, and extension member 180*a*. Similarly, extension member 180*b* may be interconnected with second link 130. For example, extension member 180*b* may be interconnected with second link 130, such that timepiece 100 provides a parallel arrangement of components in the order of case 110, second link 130, and extension member 180*b*. It should be appreciated that timepiece 100 may include any arrangement of components including, but not limited to, case 110, first link 120, second link 130, and plurality of extension members 180*a*, 180*b*, 180*c*, and 180*d* without departing from the present disclosure. It should be appreciated that timepiece 100 may include any number of extension members. It should further be appreciated that extension members 180*a*, 180*b*, 180*c*, and 180*d* may include, but are not limited to, chain links and/or straps. It should be appreciated that extension members 180*a*, 180*b*, 180*c*, and 180*d* may consist of any material including, but not limited to, metal, plastic, and/or leather. It should also be appreciated that there may be embodiments of the present disclosure wherein extension members 180*a*, 180*b*, 180*c*, and 180*d* include recessed tracks and rotate about other extension members without departing from the present disclosure. It should further be appreciated that plurality of extension members 180*a*, 180*b*, 180*c*, and 180*d* may be attached to any link and/or attached to any side of any link.

Figure 5:
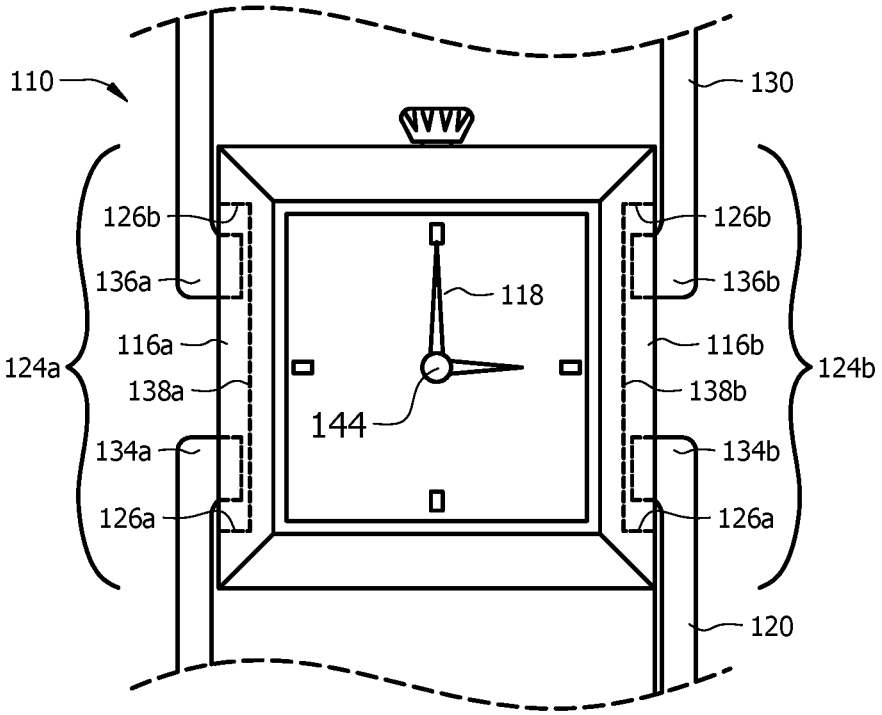
FIG. 5 depicts a top view of the case according to an embodiment of the present disclosure.

As depicted in FIG. 5 according to an embodiment of the present disclosure, first pin 134*a* of first link 120 and second pin 136*a* of second link 130 may engage first side 124*a* of case 110. Similarly, second pin 134*b* of first link 120 and second pin 136*b* of second link 130 may engage second side 124*b* of case 110. This arrangement may provide for first link 120 and second link 130 to slidably engage interior portions 116*a* and 116*b*, respectively, of case 110. When pins 134*a* and 134*b* of first link 120 are flush against first portion of interior perimeter 126*a*, and pins 136*a* and 136*b* of second link 130 are flush against second portion of interior perimeter 126*b* of case 110, a first position of timepiece 100 may be formed where first link 120 and second link 130 may be interlocked with case 110. Further, stopping walls 138*a* and 138*b* may be provided within interior portions 116*a* and 116*b*, respectively. In other words, cutouts may be formed within case 110 by interior portions 116*a* and 116*b*, and interior portions 116*a* and 116*b* may be provided one parallel to another within opposite sides 124*a* and 124*b* of case 110, respectively. For example, interior portion 116*a* may be provided in first side 124*a* of case, and interior portion 116*b* may be provided in second side 124*b* of case 110. It should be appreciated that stopping walls 138*a* and 138*b* may help to retain pins 134, 134*b* and 136*a*, 136*b*, respectively, in the first position of timepiece 100. It should be appreciated that first link 120 and second link 130 may slidably engage both first pair of tracks 112*a*, 114*a* and second pair of tracks 112*b*, 114*b*, as further described below. It should further be appreciated that first link 120 and second link 130 may form any type of engagement with pairs of tracks 112*a*, 114*a* and 112*b*, 114*b* including, but not limited to, a snapping engagement and an adjustable engagement.

As shown in FIGS. 1, 3, 4, and 6, case 110 may rotate through first opening 122 of first link 120 and through second opening 132 of second link 130. First link 120 including pins 134*a* and 134*b*, and second link 130 including pins 136*a* and 136*b* may be provided to secure first link 120 and second link 130 in opposite sides of case 110 in the first position and in the second position. The second position of timepiece 100 may be formed when case 110 is rotated approximately 180 degrees with respect to both first link 120 and second link 130 in the interlocking position. It should be appreciated that case 110 may rotate approximately 360 degrees with respect to both first link 120 and second link 130. It should also be appreciated that case 110 may lock and with both first link 120 and second link 130 with approximately every 180-degree rotation of case 110. It should further be appreciated that any number of positions may be formed by the orientation of case 110 over various degrees of rotation with respect to first link 120 and second link 130. It should also be appreciated that case 110 may assume any shape and size including, but not limited to, a square shape, a round shape, a rectangular shape, a drum shape, a large size, and a small size, without departing from the subject matter of the present disclosure. It should further be appreciated that case 110 may be provided to rotate approximately 180 degrees in any direction including, but not limited to, up, down, right and/or left without departing from the present disclosure.

Figure 2:
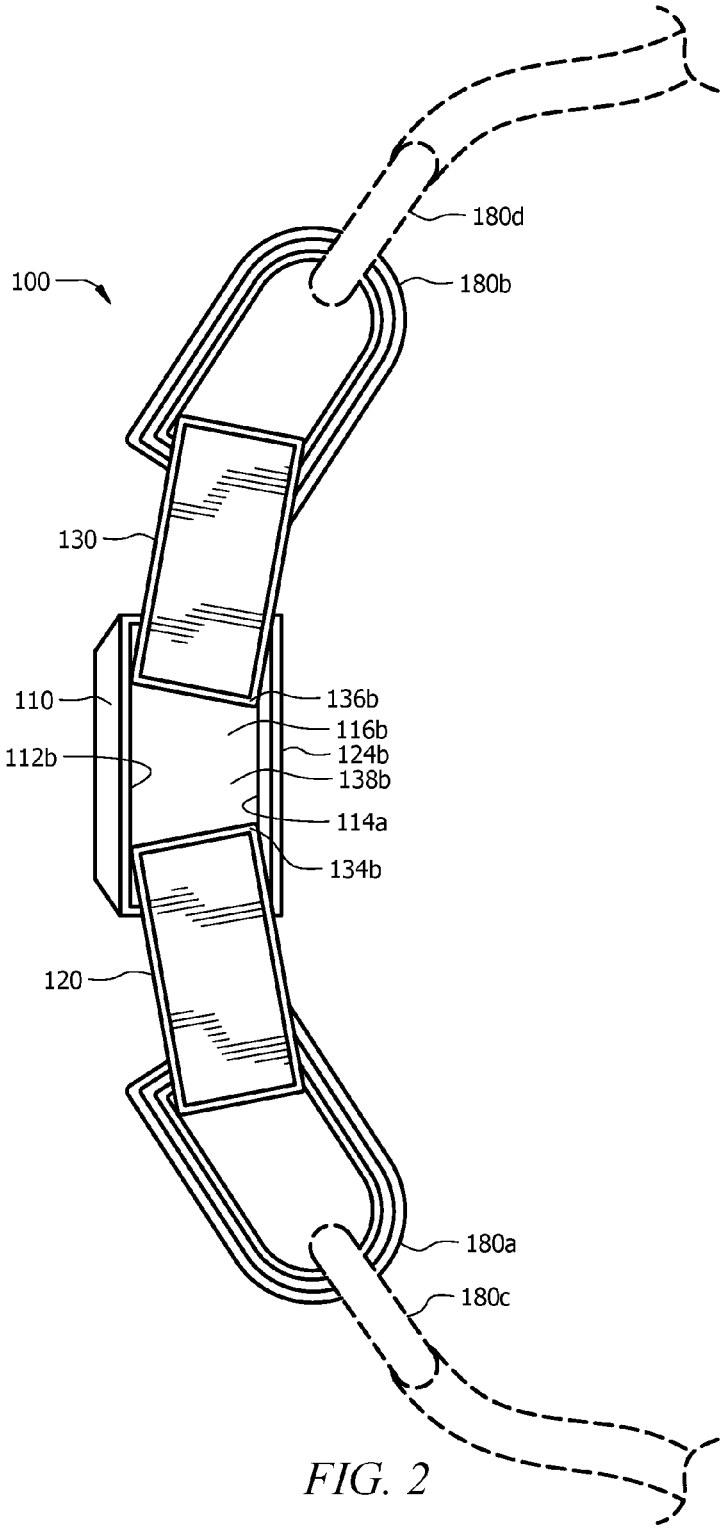
FIG. 2 depicts a side view of the timepiece, as shown in FIG. 1, according to an embodiment of the present disclosure.
Figure 3:
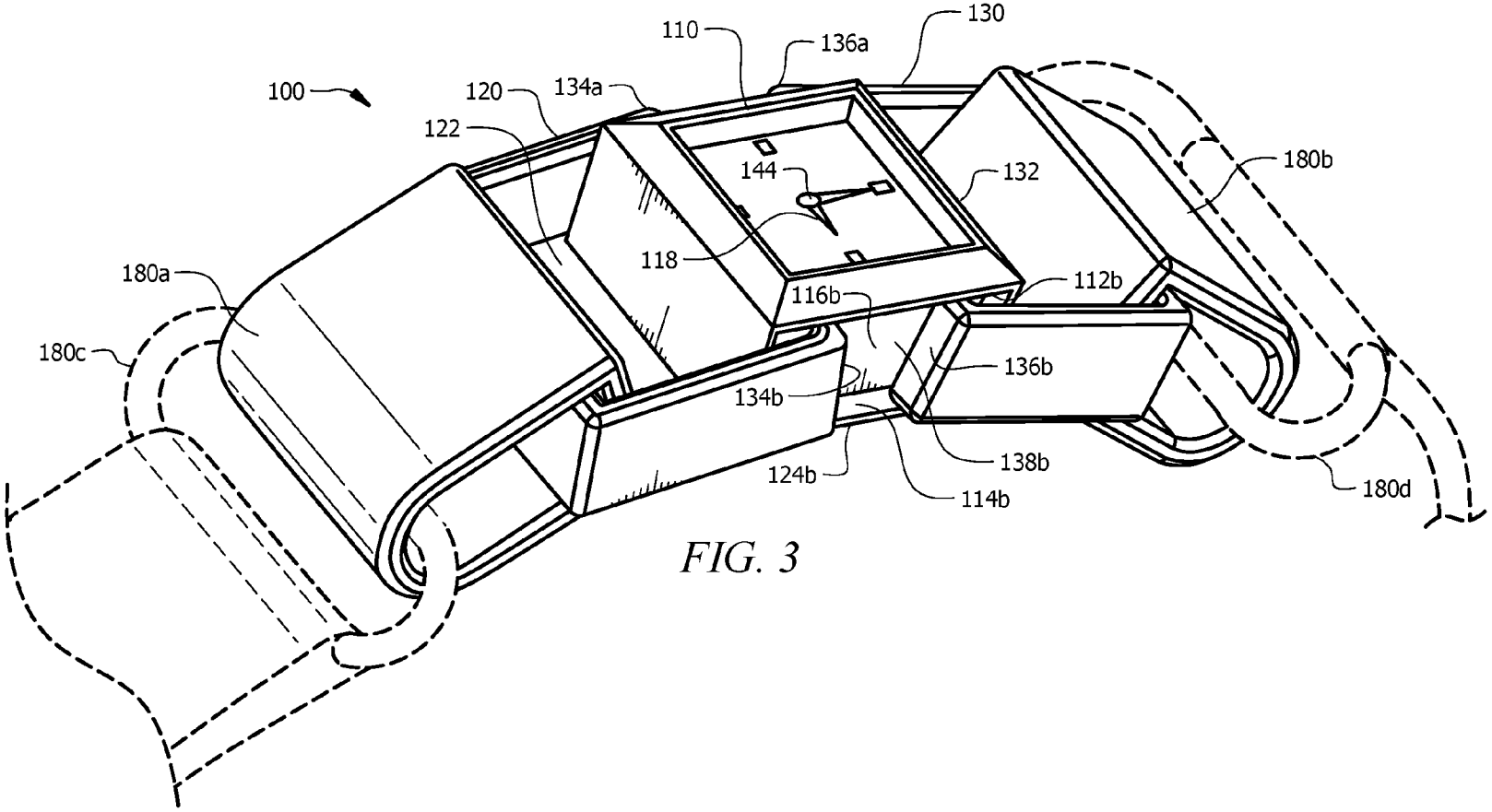
FIG. 3 depicts a perspective view of the timepiece, as shown in FIG. 1, according to an embodiment of the present disclosure.
Figure 4:
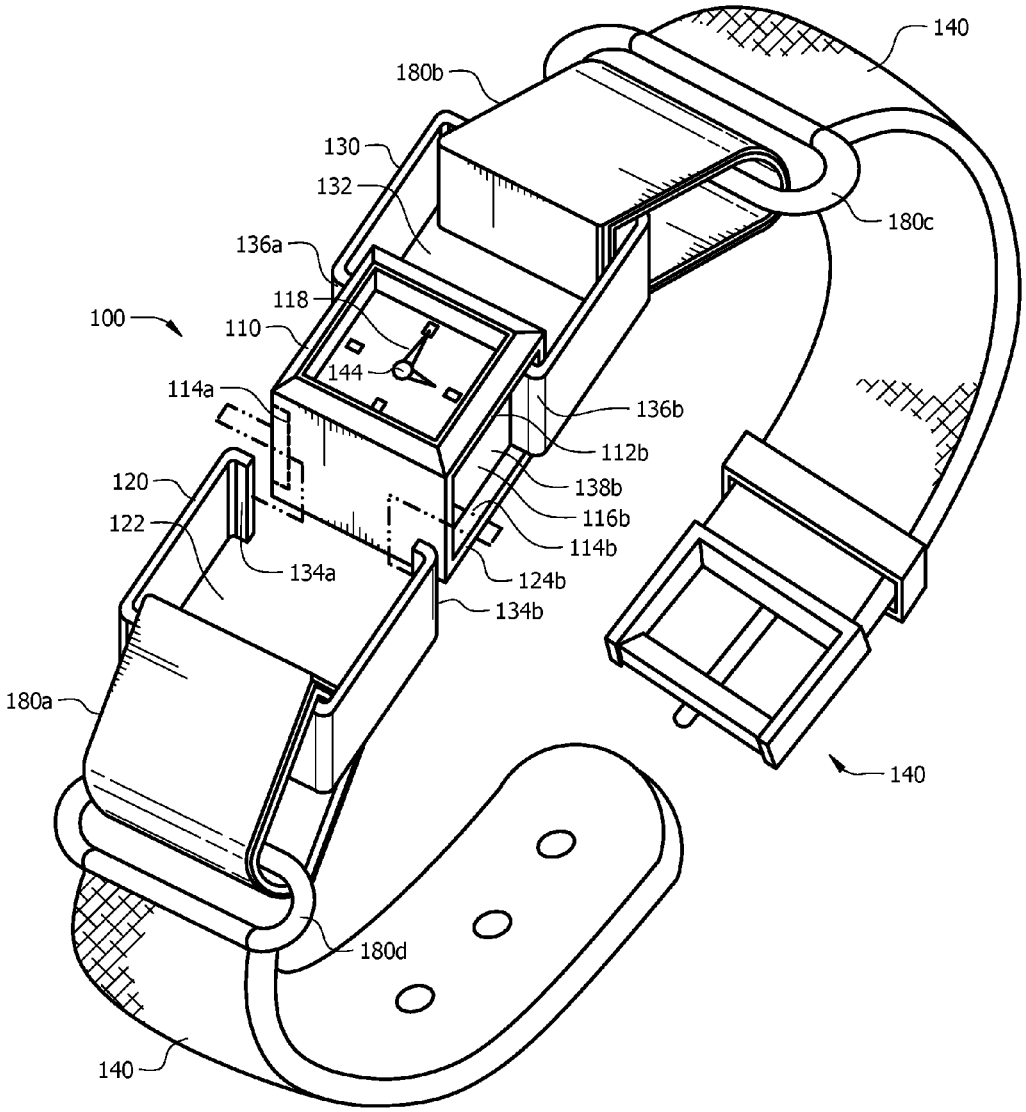
FIG. 4 depicts a perspective view of a first side of the timepiece including a strap according to an embodiment of the present disclosure.
Figure 6:
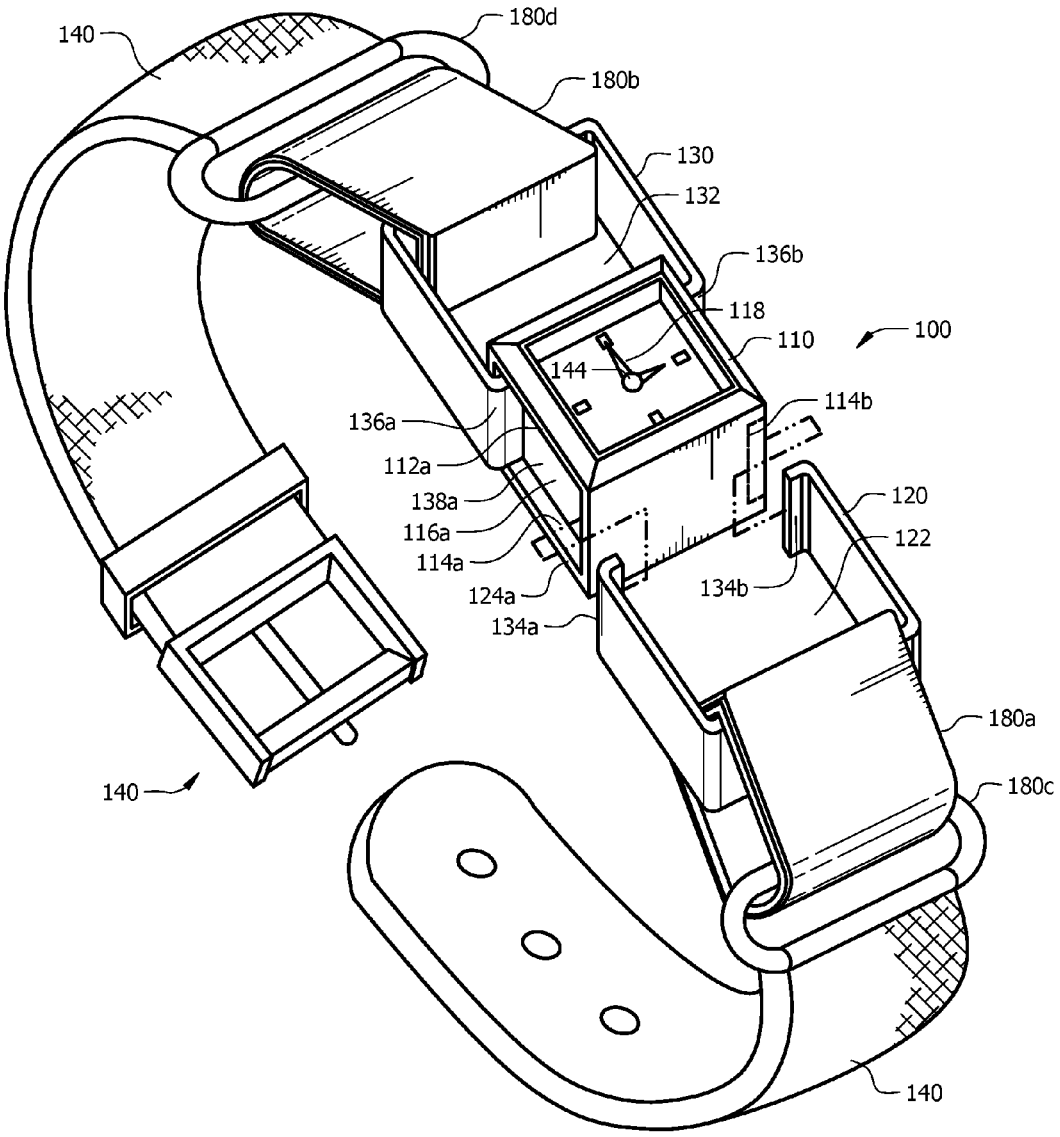
FIG. 6 depicts a perspective view of a second side of the timepiece including a strap according to an embodiment of the present disclosure.

Referring to FIGS. 1-6 according to an embodiment of the present disclosure, first link 120 may be provided in an interlocking position with first pair of tracks 112*a* and 114*a* (FIG. 6). First pair of tracks 112*a* and 114*a* may be provided in first side 124*a* (FIGS. 5-6) of case 110 and in an interlocking position with second pair of tracks 112*b* and 114*b* (FIGS. 2-4). Second pair of tracks 112*b* and 114*b* may be provided in second side 124*b* (FIG. 5) opposite of first side 124*a* (FIG. 5) of case 110. First link 120 and second link 130 may slidably engage first pair of tracks 112*a*, 114*a* (FIG. 6), and first link 120 and second link 130 may slidably engage second pair of tracks 112*b*, 114*b* (FIGS. 2-4). First pair of tracks 112*a*, 114*a* and second pair of tracks 112*b*, 114*b* may be provided within opposite interior portions 116*a* (FIG. 6) and 116*b*.

FIG. 6 depicts a view of case 110 according to an embodiment of the present disclosure. Case 110 may house first pair of tracks 112*a*, 114*a* that may be provided in first interior portion 116*a*, and second pair of tracks 112*b*, 114*b* that may be provided in second interior portion 116*b*. First pair of tracks 112*a*, 114*a* may include top track 112*a* and bottom track 114*a*. Similarly, second pair of tracks 112*b*, 114*b* may include top track 112*b* and bottom track 114*b*. Interior portions 116*a* and 116*b* may form recesses on opposite sides of case 110, and each interior portion 116*a* and 116*b* may be positioned between the opposite edges of the sides of case 110. It should be appreciated that first interior portion 116*a* may include first pair of tracks 112*a*, 114*a* and second interior portion 116*b* may include second pair of tracks 112*b*, 114*b*.

As shown in FIGS. 4 and 6 according to an embodiment of the present disclosure, strap 140 may be attached to opposite sides of timepiece 100. It should be appreciated that strap 140 may include any number of loops. For example, a double-strap having two loops may be attached to case 110 or a triple-strap having three loops may be attached to case 110. It should be appreciated that strap 140 may assume any desired length without departing from the present disclosure. It should further be appreciated that strap 140 may incorporate any material(s) including, not limited to, metal, plastic, and/or leather.

As shown in FIGS. 1 and 3-6, at least one time indicator 118 may be located on case 110. It should be appreciated that time indicator 118 may be provided at any position on case 110. It should also be appreciated that any type of time indicator may be provided including, but not limited to, a dial and/or a digital screen. It should be appreciated that a plurality of time indicators 118 may be provided on case 110. It should further be appreciated that additional indicators may be provided on case 110 including, but not limited to, a date indicator, a time zone indicator, and/or a morning (AM) and afternoon (PM) indicator. It should be appreciated that there may be embodiments of the present disclosure wherein case 110 does not include time indicator 118 without departing from the present disclosure. It should further be appreciated that there may be embodiments of the present disclosure wherein timepiece 100 may assume the form of a watch, a bracelet, a belt, a keychain and/or any other accessory without departing from the present disclosure. It should be appreciated that different colors, textures, and/or designs may be provided on each side of timepiece 100 without departing from the present disclosure.

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

The invention claimed is:

1. A timepiece comprising:

a movable case provided to rotate through a first opening of a first link and rotate through a second opening of a second link, the moveable case including a first interior portion provided in a first side of the case and a second interior portion provided in a second side of the case, the first interior portion parallel to the second interior portion, and the first interior portion and the second interior portion equidistant from a center of the case;

at least one time indicator provided on the case to display a time;

a first pair of tracks provided in the first interior portion;

a second pair of tracks provided in the second interior portion;

a first link provided in an interlocking position with both the first pair of tracks and the second pair of tracks, wherein a first pin of the first link and a second pin of the first link engage a first portion of an interior perimeter of the case, the first portion of the interior perimeter proximate the first link; and a second link provided in the interlocking position with both the first pair of tracks and the second pair of tracks, wherein a first pin of the second link and a second pin of the second link engage a second portion of the interior perimeter of the case, the second portion of the interior perimeter proximate the second link, wherein the first portion of the interior perimeter of the case is parallel to the second portion of the interior perimeter of the case, and wherein the first portion of the interior perimeter of the case and the second portion of the interior perimeter of the case are equidistant from the center of the case.

2. The timepiece of claim 1, further comprising:

a first position in which both the first link and the second link are provided in the interlocking position.

3. The timepiece of claim 2, further comprising:

a second position in which the case is rotated approximately 180 degrees with respect to the first position.

4. The timepiece of claim 1, wherein both the first link and the second link slidably engage both the first pair of tracks and the second pair of tracks.

5. The timepiece of claim 1, wherein the first interior portion is provided within a first recessed area of the case, and the second interior portion is provided within a second recessed area of the case.

6. The timepiece of claim 1, further comprising:

a plurality of extension members, comprising:

one of the plurality of extension members interconnected with the first link through the first opening, wherein the case is parallel and proximate the first link, and wherein the first link is parallel and proximate the one of the plurality of extension members; and a second one of the plurality of extension members interconnected with the second link through the second opening, wherein the case is parallel and proximate the second link, and wherein the second link is parallel and proximate the second one of the plurality of extension members.

7. The timepiece of claim 1, wherein the case rotates approximately 360 degrees about both the first link and the second link, and wherein the case locks with both the first link and the second link with approximately each 180-degree rotation of the case.

8. A movable case, comprising:

a first link provided in an interlocking position with both a first pair of tracks and a second pair of tracks, the first link having a first pin and a second pin, wherein both the first pin and the second pin of the first link engage a first portion of an interior perimeter of the case, the first portion of the interior perimeter proximate the first link; and a second link provided in the interlocking position with both the first pair of tracks and the second pair of tracks, the second link having a first pin and a second pin, wherein both the first pin and the second pin of the second link engage a second portion of the interior perimeter of the case, the second portion of the interior perimeter proximate the second link, wherein the first portion of the interior perimeter of the case is parallel to the second portion of the interior perimeter of the case, wherein the first portion of the interior perimeter of the case and the second portion of the interior perimeter of the case are equidistant from a center of the case; and wherein the case is provided to rotate through a first opening of the first link and rotate through a second opening of the second link.

9. The movable case of claim 8, further comprising:

a first interior portion provided in a first side of the case, the first interior portion including the first pair of tracks; and a second interior portion provided in a second side of the case, the second interior portion including the second pair of tracks, wherein the first interior portion is parallel to the second interior portion, and the first interior portion and the second interior portion are equidistant from the center of the case.

10. The movable case of claim 8, further comprising:

a first position in which both the first link and the second link are provided in the interlocking position.

11. The movable case of claim 10, further comprising:

a second position in which the case is rotated approximately 180 degrees with respect to the first position.

12. The movable case of claim 8, wherein the first link and the second link each slidably engage both the first pair of tracks and the second pair of tracks.

13. The movable case of claim 9, wherein the first side of the case and the second side of the case are recessed.

14. The movable case of claim 8, further comprising:

a plurality of extension members, comprising:

one of the plurality of extension members interconnected with the first link through the first opening, wherein the case is parallel and proximate the first link, and wherein the first link is parallel and proximate the one of the plurality of extension members; and a second one of the plurality of extension members interconnected with the second link through the second opening, wherein the case is parallel and proximate the second link, and wherein the second link is parallel and proximate the second one of the plurality of extension members.

15. The movable case of claim 8, wherein the case rotates approximately 360 degrees about both the first link and the second link, and wherein the case locks with both the first link and the second link with approximately each 180-degree rotation of the case.

* * * * *